United States Patent [19]

Bloom et al.

[11] Patent Number: 4,656,386

[45] Date of Patent: Apr. 7, 1987

[54] R LAMP HAVING AN IMPROVED DOME PORTION FOR INCREASING THE USEFUL LIGHT OUTPUT

[75] Inventors: Daniel M. Bloom, Euclid; Joseph A. Buccilli, Cleveland Hts.; Yilmaz C. Belentepe, Euclid, all of Ohio

[73] Assignee: General Electric Company, Schenectady, N.Y.

[21] Appl. No.: 711,328

[22] Filed: Mar. 13, 1985

[51] Int. Cl.[4] ..... F21V 7/09; H01K 1/26; H01K 1/28

[52] U.S. Cl. ..... 313/113; 313/634; 362/303

[58] Field of Search ..... 313/113, 578, 580, 634; 362/302, 303, 297, 298, 341, 346; D26/2

[56] References Cited

U.S. PATENT DOCUMENTS

| | | | |
|---|---|---|---|
| 2,181,291 | 11/1939 | Biggs | 313/113 |
| 2,901,655 | 8/1959 | Lindsay et al. | 313/113 X |
| 3,018,403 | 1/1962 | Young | 313/622 X |
| 3,652,892 | 3/1972 | Nameda et al. | 313/116 |
| 4,536,834 | 8/1985 | Sands et al. | 313/113 X |

*Primary Examiner*—Palmer C. DeMeo
*Assistant Examiner*—Sandra L. O'Shea
*Attorney, Agent, or Firm*—John P. McMahon; Philip L. Schlamp; Fred Jacob

[57] ABSTRACT

A reflector lamp (R) having an improved dome section that increases the useful light output of the lamp is disclosed. The dome section has at least three portions each with a predetermined radius. The overall dimensions of the dome section are decreased relative to that of prior art lamps without suffering a loss to the structural integrity of the lamp itself.

12 Claims, 3 Drawing Figures

Fig. 1
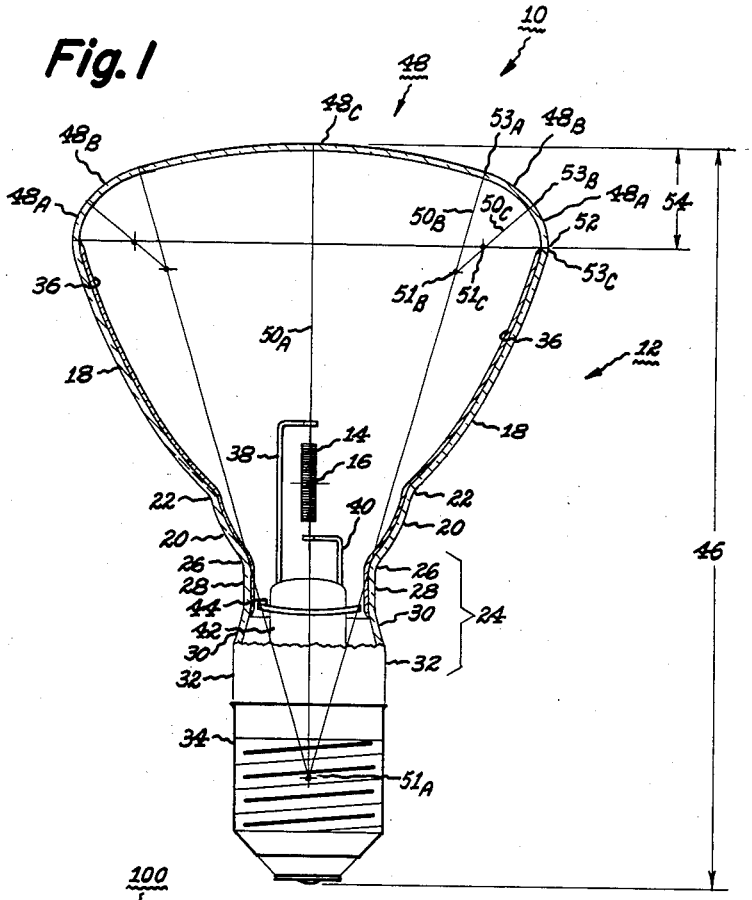
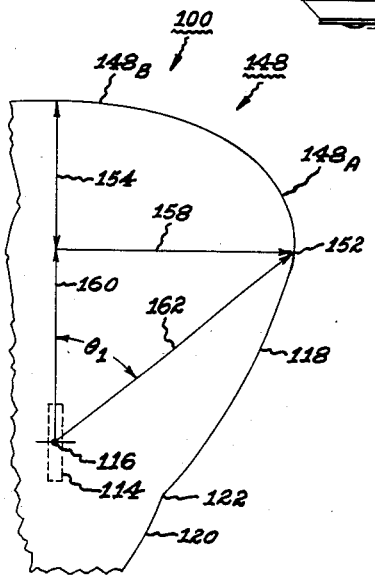
Fig. 2a
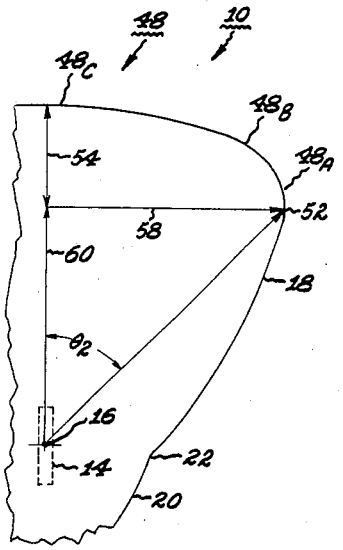
Fig. 2b

R LAMP HAVING AN IMPROVED DOME PORTION FOR INCREASING THE USEFUL LIGHT OUTPUT

BACKGROUND OF THE INVENTION

This invention is in the field of reflector lamps, such as those which include the commonly known reflector (R) lamp used for floodlighting and has spotlights.

Reflector (R) lamps are disclosed in U.S. patent application Ser. No. 612,778, filed May 22, 1984, now U.S. Pat. No. 4,536,834, assigned to the same assignee as the present invention and herein incorporated by reference. The U.S. Pat. No. 4,536,834 discloses R lamps having reflective surfaces and an improved neck portion which increases the useful light output of the R lamp.

The prior art R lamps, such as that disclosed in U.S. Pat. No. 4,536,834, have a definite overall length so as to accommodate the physical and optical characteristics of existing lighting fixtures when so inserted.

A prior art reflector lamp may be of the large blown family which type lamp is defined as having a maximum diameter of at least 2.5 inches and whose beam pattern is projected along the center axis of the lamp. The dome of the bulb of this reflector lamp may be defined as the region between the maximum diameter of the bulb and the apex of the "lens" end of the bulb. The dome height may be defined as the vertical distance from the widest or maximum diameter of the bulb to the apex of the lens end. The dome may or may not be implemented to help modulate or disperse the light projected from the lamp. The height of the dome, however, does not aid the optical performance of the lamp and therefore could be reduced without any detrimental effect to the lamp performance.

It would be desirable to completely eliminate the dome height which would make for a flat dome reflector lamp. The flat dome would allow for an increase in the length of the uppermost or primary reflective section having a reflective coating on its inside surface without a corresponding increase in the overall length of the lamp. An increased primary reflection length would improve the directional performance of the projected light beam by redirecting otherwise wasted light rays back into the useful beam pattern of the lamp. Although desirable, it is not practically feasible to provide a lamp having a flat dome due to other considerations.

The bulb during the manufacturing of the lamp and throughout the service life of the lamp may see a net, uniform, external pressure or other external loads. The flat dome contour substantially reduces the structural integrity of the bulb to this loading situation. Hence, the flat dome bulb would most likely pose a problem both from a manufacturing and usage standpoint given that the flat dome bulb might implode. Accordingly, the dome needs some curvature in order to maintain the bulb's structural integrity to the aforementioned pressure-load situation.

Prior art reflector lamps primarily in order to maintain the desired structural integrity have predominately utilized a dome contour consisting of two radii. There are also reflector lamps with dome contours consisting of more than two radii, for example, the elliptical reflector lamps utilize a number of main radii and fillet radii in the dome contour. There are also other reflector lamps with relatively long dome heights which utilize more than two radii in the dome contour. The known prior art elliptical and long height dome reflector designs have a dome height to maximum diameter ratio of greater than 0.24. For a given maximum diameter, it is desired that this ratio be reduced in order that the height of the dome be reduced to allow for an increase in the reflector length which thereby increases the useful light output of the reflector lamp. This ratio reduction should be accomplished while still maintaining the structure integrity of the dome section and also maintaining the overall length of the lamp.

Accordingly, an object of the present invention is to provide a reflector lamp having a dome section which is reduced in height relative to prior art lamps so as to provide more useful light output while still maintaining the structural integrity of the dome and also the overall length of the reflector lamp itself.

SUMMARY OF THE INVENTION

In accordance with the present invention a reflector lamp having an improved dome portion which allows for increasing the useful light output of the reflector lamp is provided. The reflector lamp has a predetermined overall length and comprises an electrically conductive base, and a finite light source which has a geometric center. The light source is rigidly affixed to an electrically insulated stem connected to the electrically conductive base. The reflector lamp has a concave reflector having a focal point at which the geometric center of the finite light source is approximately located. The concave reflector comprises a primary reflector section having a parabolic shape with a focal point, a predetermined length, and a predetermined diameter (D) between its outermost curved portions. The concave reflector may further comprise one or more intermediate reflector sections each having a parabolic shape which is substantially confocal with the primary reflective surface. The concave reflector has a neck section affixed to the electrically conductive base. The concave reflector further has a dome section which is light-transmissive and joined to the front portion of the primary reflective section. The dome section has at least three portions each having a predetermined radius of curvature. The dome section has a predetermined height (H) which is proportional to the predetermined diameter (D) of the primary reflective section. The ratio of the height (H) of the dome to the maximum diameter (D) of the reflective section has a selected value which is less than 0.24 but greater than about 0.15. The height of the dome section is reduced relative to prior art reflector lamps and the overall length of the lamp is maintained relative to prior art reflector lamps. The reduced section of the dome provides for an increase in the useful light output of the reflector lamp.

A more complete understanding of the present invention is obtained by considering the following description in conjunction with the accompanying drawings.

BRIEF DESCRIPTION OF THE DRAWING

FIG. 1 shows a reflective lamp in accordance with the present invention.

FIG. 2(*a*) illustrates the relatively wide angle of light transmission due to the dome section of prior art lamps not having the benefit of the present invention.

FIG. 2(*b*) illustrates one of the improvements of the present invention having a decreased angle of light transmitted by the lamp so as to narrow and enhance the directional beam performance of the lamp.

DESCRIPTION OF THE PREFERRED EMBODIMENTS

FIG. 1 illustrates an improved reflector (R) lamp 10 in accordance with the present invention. The lamp 10 comprises a concave reflector 12 and a light source 14 having its geometric center 16 located approximately at the focal point of the concave reflector 12. The concave reflector 12 comprises a reflector section 18 having a parabolic shape and a focal point. The reflector 12 may preferably have an intermediate reflective section 20 having a parabolic shape substantially confocal with the primary reflective section 18 and preferably joined to the primary reflective section 18 by a transitional section 22 preferably having a radius of curvature in the range of about 1.0 mm to about 3.0 mm.

The concave reflector 12 further preferably has a neck section 24 which preferably consists of a blending section 26, a first substantially straight cylindrical section 28, an expanding section 30, and a second substantially straight cylindrical section 32 which is sealed and attached to the electrically conductive base 34. The neck section 24 may be that of the previously described U.S. Pat. No. 4,536,834 to which reference may be made for further details.

The cylindrical sections 32 and the expanding section 30 are uncoated, clear translucent sections, whereas, cylindrical section 28, blending section 26, intermediate section 20, transitional section 22 and the primary reflective section 18 are all coated with a reflective material 36 such as silver or aluminum shown in cross-hatch in an enlarged manner in FIG. 1.

The light source 14 of the lamp 10 may be preferably axially aligned in a vertical manner parallel to the lamp axis or it may be preferably aligned in a horizontal manner perpendicular to the lamp axis. The light source 14 is neither infinite or infinitesimal in size and its geometric center is approximately centered at the focal point of the concave reflector 12 and is generally either perpendicular or parallel to the axis of the lamp 10.

The light source 14 can be a filament preferably made of tungsten and mounted between a pair of inner lead wires 38 and 40 of suitable material such as copper plated with nickel. Alternate light sources can be employed in place of the tungsten filament such as a halogen lamp or an arc discharge lamp. These alternate light sources act as a finite light source.

The inner leads 38 and 40 extend through a glass stem 42 and are electrically connected to appropriate portions (not shown) of the electrically conductive base 34. The lamp 10 further preferably comprises a light-reflective heat shield 44 which may be flat or more preferably a parabolic shape and its upper portion has a reflective surface positioned under the finite light source 14. The heat shield 44 is mounted onto the glass stem 42.

The reflector lamp 10 has a predetermined overall length 46 as shown in FIG. 1, and has typical values in the range of about 120 to 175 mm.

The lamp 10 further comprises a dome section 48 which is of primary interest to the present invention. The dome section 48 is joined to the front portion of the primary reflective section 18. The dome section is light-transmissive and can have a prismatic arrangement on its surface to diffuse, disperse, regulate or modulate the light output of lamp 10. The dome 48 can be acid etched, grit blasted, stain or any other surface treatment to modulate or disperse the light.

The dome section 48 has at least three portions $48_A$, $48_B$, and $48_C$, each with a predetermined radius $50_A$, $50_B$, and $50_C$, respectively. The radius $50_A$ is the major radius having a center location $51_A$. The radius $50_B$ is the transitional radius having a center location $51_B$. The radius $50_C$ is the end radius having a center location $51_C$. FIG. 1 shows a location $53_A$ which is the point of tangent between the major and transitional radii. Similarly, FIG. 1 shows a location $53_B$ which is the point of tangent between the transitional and end radii. Further, FIG. 1 shows a location $53_C$ which is the point of tangent between the end radius and the reflective section 18.

The range values for each of the predetermined radii are given in Table 1.

TABLE 1

| Predetermined Radius | Range in mm of the Radius |
|---|---|
| $50_A$ | 10 to 20 |
| $50_B$ | 20 to 50 |
| $50_C$ | 130 to 180 |

The dome section 48 mates with the concave reflector 12 at location 52 which represents the intersection of the widest or maxiumum predetermined diameter (D) of the outermost curved portions of the primary reflective section 18. The dome section 48 has a predetermined height (H) 54 measured from location 52 to the apex of portion $48_C$ of dome 48.

The dome section 48 of the present invention has a height 54 that is reduced relative to the dome sections of prior art reflector lamps. The reduction to the dome section 48 is accomplished while maintaining the overall length 46 of the lamp 10 relative to prior art lamps. Further, the dome section 48 allows for the angle of light transmitted from the lamp 10 to be narrowed relative to prior art reflector lamps. The improvement provided by the dome section 48 of the present invention may be more readily appreciated by first referring, in a comparative manner, to a prior art reflector lamp 100 partially shown in FIG. 2(*a*).

FIG. 2(*a*) uses reference numbers, increased by a value of 100 relative to FIG. 1, to show elements similar to those described with regard to FIG. 1. The lamp 100 has a light source 114 having a mid-portion 116 approximately located at the focal point of the lamp 100. FIG. 2(*a*) shows the prior art lamp 100 as having a dome section 148 comprised of a first portion $148_A$ and a second portion $148_B$. The dome section 148 has a height (H) 154 measured from the location 152 to the apex portion $148_B$ of dome 148.

FIG. 2(*a*) illustrates a triangle having three sides 158, 160 and 162 defining an angle $\theta_1$ which is herein termed the transmission angle of the light emitted by the lamp 100. The side 158 is a transverse distance extending from the axis of the lamp 100 to location 152. The side 160 is longitudinal distance extending from focal point 116 to the intersection of side 158. The side 162 is a diagonal distance extending from focal point 116 to the location 152. The transmission angle $\theta_1$ of lamp 100 may be represented by the following expression:

$$\tan \theta_1 = \frac{\text{Side 158}}{\text{Side 160}} \quad (1)$$

This prior art reflector lamp 100 may have a typical transmission angle $\theta_1$ of 53°. The present invention decreases this transmission angle by a factor of 1.04 to 1.08. The present invention allows for the decrease in transmission angle without effecting the overall length or strength of the bulb and may be described in a comparison manner with reference to FIG. 2(*a*) and FIG. 2(*b*).

FIG. 2(*b*) is similar to FIG. 2(*a*) and shows similar elements discussed with regard to FIG. 2(*a*) represented by reference numbers decreased by a value of 100. A comparison between FIGS. 2(*a*) and 2(*b*) reveals that height 54 of dome section 48 of the present invention is less than the height 154 of the prior art dome section 148. A representative value of this reduced distance is about 5 mm. Conversely, due to this reduced height 54, the side 60 of FIG. 2(*b*) is increased by a typical value of 5 mm relative to side 160 of FIG. 2(*a*). Accordingly, due to the increased value of side 60 the angle of transmission $\theta_2$ of FIG. 2(*b*) is decreased relative to the prior art angle of transmission $\theta_1$. The angle of transmission $\theta_2$ has a decreased range of 48 to 51 relative to the transmission angle $\theta_1$ of the prior art lamps 100. The decrease in transmission $\theta_2$ allows for more light to be reflected back into the primary beam pattern of the lamp 10 relative to the lamp 100 by a value of 2–3%.

The improved directional beam performance of lamp 10 provided by dome section 48 is accomplished without suffering any loss to the structural integrity of the lamp discussed in the "Background" Section. Known prior art reflectors have predominately implemented a dome section having two radii such as lamp 100. Further, known elliptical and long length dome sections of reflector lamps have implemented greater than two radii. One of the common features between all known reflector lamps is that the ratio of the dome height to the widest or maximum diameter of the reflector lamp is greater than 0.24. This ratio of 0.24 is selected in order to preserve the structural integrity of the lamp with regard to the reflector lamp withstanding typically experienced pressure-load situations.

In our initial attempt to reduce the dome height, it was found that a contour consisting of two radii was unsatisfactory from a bulb integrity standpoint. Further pursuit yielded that the dome height could be reduced by a factor of about 16%, if the dome section had at least three radii, such as $\mathbf{50}_A$, $\mathbf{50}_B$ and $\mathbf{50}_C$ disclosed with regard to FIG. 1. The pursuit established that the ratio of the height (H) of the dome section to the maximum diameter (D) of the reflective section 18 could be less than 0.24.

In accordance with the practice of this invention, a reflector lamp having a standard dome contour with two radii, a reflector lamp having a dome section with a 16% reduction in dome height with two radii, and a reflector lamp having the benefits of the present invention and with a reduction in dome height of 16% with three radii were all subjected to experimental implosion tests. The results of such testing are tabulated in Table 2.

TABLE 2

IMPLOSION RESULTS FOR STANDARD DOME CONTOUR WITH 2 RADII AND DOME CONTOURS WITH A 16% REDUCTION IN DOME LENGTH

| REFLECTOR LAMPS | MEAN IMPLOSION PRESSURE (PSIA) | STANDARD DEVIATION (PSIA) |
|---|---|---|
| Standard Dome Contour with | 47 | 7.5 |

TABLE 2-continued

IMPLOSION RESULTS FOR STANDARD DOME CONTOUR WITH 2 RADII AND DOME CONTOURS WITH A 16% REDUCTION IN DOME LENGTH

| REFLECTOR LAMPS | MEAN IMPLOSION PRESSURE (PSIA) | STANDARD DEVIATION (PSIA) |
|---|---|---|
| Two Radii Reflector Lamp with Domes Having a 16% Reduction in Dome Height Utilizing Two Radii | 34 | 5.0 |
| Reflector Lamp 10 with A Dome Having A 16% Reduction in Dome Height Utilizing Three Radii | 47 | 4.6 |

In Table 1, the results of an experimental implosion test are presented in which a standard dome contour was compared to two dome contours with a 16% reduction in dome height. The implosion test consisted of a destructive test where the value of the net, uniform, external pressure required to rupture the bulb was measured and given in Table 1. The two radii dome contour with a 16% reduction in dome length, as shown in Table 1, is substantially weaker than the standard two radii dome, but the low dome profile of the present invention with more than two radii showed no reduction in strength relative to the reflector having a standard dome contour.

It should now be appreciated that the present invention provides an R lamp 10 having a decreased angle of transmission of the light emitted from the lamp and without any decrease in the structural integrity of the lamp 10. Further, both of these achievements are accomplished while still maintaining the overall length of the lamp 10.

It should be further appreciated that although the hereinbefore description preferably described the lamp 10 as having one or more intermediate reflective sections 20, the practice of this invention contemplates that the lamp 10 need not have any intermediate reflective sections 20. For such a lamp 10, the primary reflective section 18 would be contoured to encompass the one or more intermediate sections 20. Further, as previously discussed, although the lamp 10 preferably has a neck section 24, the practice of this invention contemplates that the primary reflective section 18 can be contoured to encompass the neck section to mate with the electrically conductive base 34.

What I claim as new and desire to secure by Letters Patent of the United States is:

1. A reflector lamp comprising:

(a) an electrically conductive base;

(b) a finite light source having a geometric center and rigidly affixed to an electrically insulated stem which is connected to said electrically conductive base;

(c) a concave reflector having a focal point at which the geometric center of the light source is approximately located, said concave reflector comprising;

($c_i$) a primary reflective section having a parabolic shape, a focal point, a predetermined length and a predetermined maximum diameter (D) between its outermost curved portions; said primary reflective section being contoured so as to be affixed to said electrically conductive base;

(d) a light-transmissive dome section joined to the front portion of said primary reflective section, said dome section having at least three portions each with a predetermined radius, said dome section having a predetermined height (H) which is proportional to the predetermined diameter (D) of the reflective section by a ratio which is less than 0.24 but greater than about 0.15.

2. A reflector lamp comprising:

(a) an electrically conductive base;

(b) a finite light source having a geometric center and rigidly affixed to an electrically insulated stem which is connected to said electrically conductive base;

(c) a concave reflector having a focal point at which the geometric center of the light source is approximately located, said concave reflector comprising;

($c_i$) a primary reflective section having a parabolic shape, a focal point, a predetermined length and a predetermined diameter (D) between its outermost curved portions;

($c_{ii}$) one or more intermediate reflective sections each having a parabolic shape substantially confocal with said primary reflector surface and each respectively joined together;

($c_{iii}$) a neck section affixed to said electrically conductive base;

(d) a light-transmissive dome section joined to the front portion of said primary reflective section, said dome section having at least three portions each with a predetermined radius, said dome section having a predetermined height (H) which is proportional to the predetermined diameter (D) of the reflective section by a ratio which is less than 0.24 but greater than about 0.15.

3. A reflector lamp according to claim 1 wherein said dome section comprises:

(a) said first portion having said radius in the about 10 mm to about 20 mm;

(b) said second portion having said radius in the range of about 20 mm to about 50 mm; and (c) said third portion having said radius in the range of about 130 mm to about 180 mm.

4. A reflector lamp according to claim 1 wherein said primary reflective section has a reflective coating covering all of its internal surface including those surfaces which mate with said dome section.

5. A reflector lamp according to claim 2 wherein said neck section comprises:

a blending section, a first substantially straight section, and an expanding section, a second substantially straight section for mating with the electrically conductive base.

6. A reflector lamp according to claim 1 further comprising a light-reflective heat shield having a reflective surface that is positioned under said light source and mounted to said electrically insulative stem.

7. A reflector lamp according to claim 1 wherein said light source is axially aligned parallel to lamp axis.

8. A reflector lamp according to claim 1 wherein said light source is aligned perpendicular to the lamp axis.

9. A lamp according to claim 1 wherein said light source comprises a tungsten filament.

10. A reflector lamp according to claim 1 wherein said light source comprises a halogen lamp.

11. A reflector lamp according to claim 1 wherein said light source comprises an arc discharge lamp.

12. A reflector lamp according to claim 1 wherein said dome section has a prismatic arrangement on its surface which serves to modulate light emitted from said lamp.

* * * * *